US007549850B2

(12) United States Patent
Trapalis

(10) Patent No.: US 7,549,850 B2
(45) Date of Patent: Jun. 23, 2009

(54) ROTARY MECHANISM

(75) Inventor: Yannis Trapalis, Thornbury (AU)

(73) Assignee: KCR Technologies Pty Ltd, Thornbury, Victoria (AU)

( * ) Notice: Subject to any disclaimer, the term of this patent is extended or adjusted under 35 U.S.C. 154(b) by 107 days.

(21) Appl. No.: 10/569,656

(22) PCT Filed: Aug. 27, 2004

(86) PCT No.: PCT/AU2004/001165

§ 371 (c)(1),
(2), (4) Date: May 24, 2006

(87) PCT Pub. No.: WO2005/021933

PCT Pub. Date: Mar. 10, 2005

(65) Prior Publication Data

US 2006/0233653 A1 Oct. 19, 2006

(30) Foreign Application Priority Data

Aug. 27, 2003 (AU) ..... 2003904633

(51) Int. Cl.
*F01C 1/02* (2006.01)
*F04C 18/00* (2006.01)

(52) U.S. Cl. ..... 418/59; 418/61.1; 418/61.2

(58) Field of Classification Search ..... None
See application file for complete search history.

(56) References Cited

U.S. PATENT DOCUMENTS 1,310,157 A * 7/1919 Campo ..... 418/54
1,340,625 A * 5/1920 Planche ..... 418/54
1,802,887 A * 4/1931 Feyens ..... 418/54
3,459,367 A * 8/1969 Pfaff et al. ..... 418/54
3,690,791 A * 9/1972 Dieter et al. ..... 418/61.1
3,800,760 A 4/1974 Knee ..... 123/8.09
3,913,408 A * 10/1975 Moore ..... 74/63
3,996,901 A * 12/1976 Gale et al. ..... 123/242
4,061,445 A * 12/1977 Doshi ..... 418/54
4,118,157 A * 10/1978 Mayer ..... 418/1
4,296,500 A * 10/1981 Monties et al. ..... 623/3.13
4,300,874 A * 11/1981 Georgiev ..... 418/54
4,458,480 A * 7/1984 Irwin ..... 60/39.63

(Continued)

FOREIGN PATENT DOCUMENTS

DE 195 14 531 10/1996

(Continued)

OTHER PUBLICATIONS

International Search Report dated Sep. 27, 2004.

*Primary Examiner*—Thomas Denion
*Assistant Examiner*—Douglas J. Duff
(74) *Attorney, Agent, or Firm*—Bromberg & Sunstein LLP

(57) ABSTRACT

A rotary mechanism (10) has an annular (chamber 12) defined by an inner wall (16) of housing (11). A symmetrical two lobed rotor (15) has opposing side faces (21*a*, 21*b*) a longitudinal axis between apices (22). A drive shaft (50) eccentrically rotates rotor by a block (51) and slot (52) reciprocating arrangement and a second supporting means (53). The centre of the rotor follows a circular orbit in the chamber (12). The apices (22) continuously sweep the inner wall (16) creating cavities (25) of successively increasing and decreasing volumes with associated fluid inolet and exhaust port (31, 35).

21 Claims, 8 Drawing Sheets

U.S. PATENT DOCUMENTS 4,551,073 A * 11/1985 Schwab ..... 417/352
5,127,377 A * 7/1992 Yang ..... 123/242
5,295,814 A * 3/1994 Uebel ..... 418/60
5,439,357 A * 8/1995 Barthod et al. ..... 417/410.3
6,974,313 B2 * 12/2005 Beaudoin ..... 418/54
7,264,452 B2 * 9/2007 Sbarounis ..... 418/54

FOREIGN PATENT DOCUMENTS

WO WO 93/21423 10/1993
WO WO 01/69061 9/2001

* cited by examiner

ROTARY MECHANISM

The present invention relates to a rotary mechanism of the kind having a two-lobe rotor eccentrically driven inside an enclosed chamber to compress or expand fluid inside the chamber.

The rotary mechanism has application in all manner of machines including hydraulic pumps, gas compressors, gas expanders and rotary engines.

There have been proposed a large number of different types of rotary machines intended for operation in pumps, compressors, expanders and rotary engines. Most known rotary machines have had limited operating success in any one of the above-mentioned applications, and it is not known of any rotary machine that is suitable for successful operation in all these applications.

A particular type of rotary machine comprises a two-lobe lenticular rotor, or blade, rotatably mounted in an annular chamber that has a circular-conchoidal configuration. Rotary motion of the two-lobe rotor must be carefully guided to ensure apices of the two-lobe rotor always remain in sliding and sealed contact with the inner wall of the chamber thereby continuously altering the volume of the space between the rotor and the chamber wall. An inlet into the chamber allows for entry of a fluid which, upon compression by the rotor, is expelled through an outlet.

In one known rotary machine an open-ended crankshaft extends through one end cover of the chamber and supports the rotor. A drive mechanism rotates the crankshaft thereby rotating the rotor within the chamber. Rotor motion is guided by a gear system fitted in one end of the lenticular rotor. The problem with this design is that the gear system will not adequately endure the high vibrational stresses and loads on the machine during operation.

Rotary machines of the type described above having an eccentrically rotating centre of rotor mass inherently experience a tilt or pull in one direction. Despite increasing the rigidity of the chamber housing and introducing spinning counterweights, complex designs such as those having a gear system guiding means on one side of the rotor, or any other design where the machine's symmetry is disturbed, are still unable to counteract normal machine tilt and therefore operate out of balance.

Another version of known rotary machines uses spindles extending through slots where the interrelationship of the slots with the spindles is such that reciprocal sliding motion of the spindles within the slots guides the rotor to eccentrically rotate within the chamber. However, this design is structurally too weak to bear the continual stresses of vibrations under the normal operating conditions of pumps, compressors, expanders, engines, and the like. The spindles, which at times during a rotor's cycle each bear the full load of the moving rotor, are unable to withstand repeated loading and will shear.

As far as internal combustion engines are concerned, only the Wankel rotary design has been successfully used in engines. However, even the Wankel engine fails in that a low thermodynamic efficiency as a result of the rotating three lobed rotor in the epitrochoidal chamber allows it to only be suitable for use at high revolutions and for light vehicles. The compression ratio is low because at top dead centre at the engine's maximum compression the rotor straddles the epitrochoidal chamber leaving two small gaps of uncompressed fuel between the rotor and chamber wall. Loss of chamber contact by the rotor is especially noticeable at low revolutions. Sealing of the three lobed rotor in a chamber of this shape is also particularly difficult.

In all rotary machines particular thermodynamic inefficiencies are brought about by difficulties in maintaining good chamber sealing. As many known rotary machines have complex rotors often following a complex chamber shape, the tip seals at the apices are required to extend greater and lesser amounts from the rotor. On many occasions the tip seals themselves bear loads while the rotor is operating making them susceptible to wear and leakages. Additional features, such as gear systems and slots, increase the number of areas where fluid leakage may occur and because of the size and positioning of the additional features, seal placement may not be effective. As it would be appreciated, the more complex the rotor and chamber shapes the greater difficulties are encountered with chamber sealing. Additionally, more complex designs with greater number of components are more expensive and more difficult to manufacture and maintain.

Often, too, rotary machines suffer from other thermodynamic disadvantages in that it has been difficult to effectively cool the rotor. Cooling problems can, in turn, lead to difficulties in maintaining the integrity of the metal, particularly that of the rotor, which can reach high temperatures.

Wearing of machine parts and in particular rotor driving means such as gear systems and slot systems are common problems leading to seizure of machines. A main reason for this is that with many designs the moving components are forced to bear large point loads or to bear uneven loads resulting in one section of a component wearing more than another section. This in turn produces further vibrations exacerbating the wearing by placing greater loads bearing on points of weakness.

An improved rotary mechanism is therefore required that will operate thermodynamically efficiently as an engine to provide a compression ratio that can adequately power all manner of vehicles. The mechanism should be economical to manufacture, seal and wear well, and easily bear full loads when operating as a pump, compressor, engine, or the like.

According to one embodiment the present invention provides a rotary mechanism comprising:

- a housing defining a substantially annular enclosed chamber with an inner wall;
- a two-lobe symmetrical rotor having a central longitudinal axis between apices of the rotor;
- a drive shaft supporting the rotor to slide and rotate the rotor eccentrically within the chamber in such a manner that the apices continuously sweep in a wall thereby creating cavities between each lobe and the inner wall of successively increasing and decreasing volumes; and
- spaced inlet and exhaust ports for the supply and discharge of fluid into the cavities;
  - wherein the rotor is supported to slide and rotate eccentrically on the drive shaft by a block and slot reciprocating arrangement and by a second supporting means.

According to another embodiment the present invention provides a rotary mechanism comprising:

- a housing defining a substantially annular enclosed chamber with an inner wall;
- a two-lobe symmetrical rotor having a central longitudinal axis between apices of the rotor, the rotor being disposed within the chamber so as to slide and eccentrically rotate within the chamber in such a manner that the apices continuously sweep the inner wall thereby creating cavities between each lobe and the inner wall of successively increasing and decreasing volumes, wherein the rotor is mounted on a shaft extending through at least one end of the chamber, the shaft carrying a first guiding means being a block mounted for reciprocal movement relative to an elongated slot located on the rotor, whereby the block and shaft allow for sliding and eccentric rotation of the rotor;
- spaced inlet and exhaust ports for the supply and discharge of fluid into the cavities; and a second guiding means that interacts with the first guiding means to guide the rotor and ensure the apices, during operation, are in continuous sealing contact with the inner wall wherein this guiding means is centred on an origin offset to the centre of the chamber.

Preferably the guiding means are guiding components structured to have matching contact surfaces such that contact loads between the interengaging guiding components are equally distributed along the guiding components.

Preferably, the guiding components comprise: a circular guide disc mounted at, at least, one end of the annular chamber; and a corresponding circular recess on one side of the rotor to receive the guide disc, wherein the recess has its origin at the centre of the rotor and is larger than the guide disc to allow limited movement of the rotor on the disc. The centre of the guide disc is typically off-centre to a central axis of the chamber and, particularly, located midway between the central axis of the chamber and an axial centre of the shaft.

Preferably, two guide discs are provided, one at each chamber end, the discs being receivable in corresponding circular recesses located in each side face of the rotor. The shaft is ideally a single block shaft extending through the rotor and chamber, and the elongate slot is oriented along the longitudinal axis of the rotor.

According to another embodiment of the present invention there is further provided a rotary mechanism comprising:

a housing defining a substantially annular enclosed chamber with an inner wall;

a two-lobe symmetrical rotor having a central longitudinal axis between apices of the rotor, the rotor being disposed within the chamber so as to slide and eccentrically rotate within the chamber in such a manner that the apices continuously sweep the inner wall thereby creating cavities between each lobe and the inner wall of successively increasing and decreasing volumes, wherein the rotor is mounted on a split shaft system including a first shaft extending through one end of the chamber and a second shaft extending through the other end, the first shaft carrying a first block mounted for reciprocal movement relative to a first elongated slot that is oriented along the longitudinal axis of the rotor, the second shaft carrying a block mounted for reciprocal movement relative to a second elongate slot oriented perpendicularly to the first slot, wherein the blocks and shafts allow for sliding and eccentric rotation of the rotor and the load of the rotor is successively borne by each block and shaft; and spaced inlet and exhaust ports for the supply and discharge of fluid into the cavities.

The first and second shafts are preferably aligned axially offset from one another with one shaft having its axial centre aligned with a central axis of the chamber.

The centre of the rotor's circular orbit is offset to the central axis of the chamber and specifically midway between the central axis and the axial centre of the shaft that is not aligned with the central axis.

It will be appreciated that, depending upon the porting, such arrangements can be used as positive displacement hydraulic pumps, gas compressors, gas expanders or as rotary engines.

BRIEF DESCRIPTION OF THE DRAWINGS

The present invention is described further by way of example with reference to the accompanying drawings by which.

DETAILED DESCRIPTION OF PREFERRED EMBODIMENTS OF INVENTION

Figure 1:
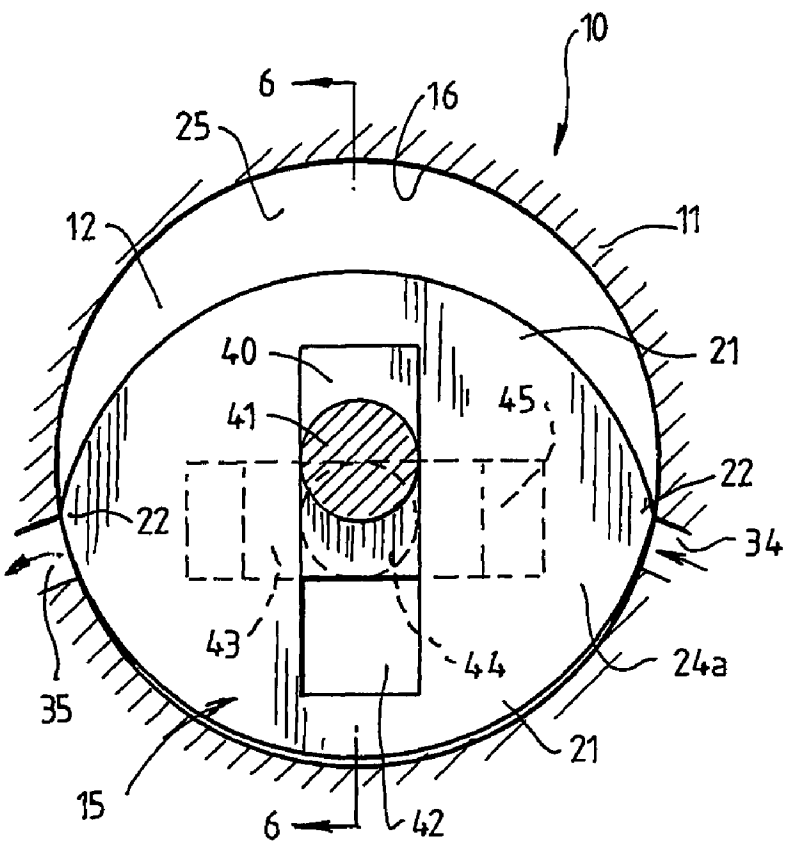
FIG. 1 is a schematic plan view of a first embodiment of a rotary mechanism in accordance with the invention, with a rotor at top dead centre of a chamber.
Figure 2:
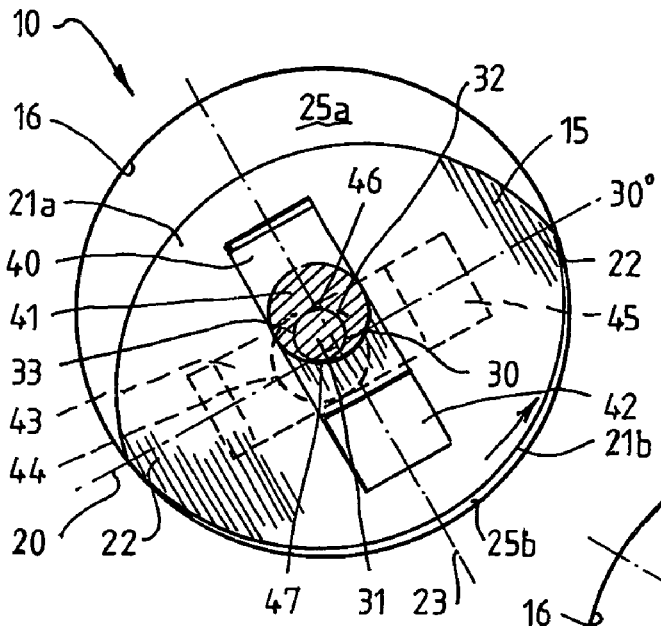
FIG. 2 illustrates the mechanism of FIG. 1 with the rotor displaced by 30° counter-clockwise.
Figure 3:
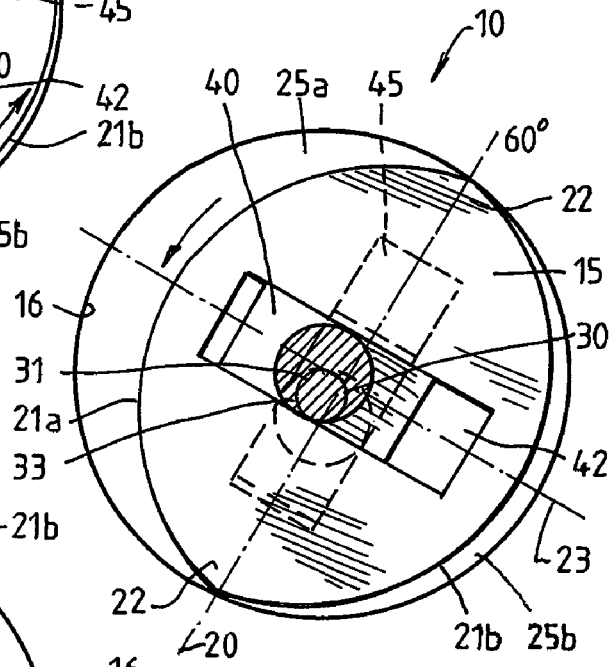
FIG. 3 illustrates the mechanism of FIG. 1 with the rotor displaced by 60° counter-clockwise.

FIGS. 1 and 2 illustrate two embodiments of a rotary mechanism 10 suitable for use in a variety of applications including hydraulic pumps, gas compressors, gas expanders and rotary engines. In both embodiments the mechanism 10 has a rotor disposed within an enclosed chamber that eccentrically rotates to successively increase and decrease in size enclosed spaces in the chamber thereby drawing fluid into the chamber through an inlet and expanding the fluid or compressing the fluid, depending on the positions of inlet and outlet ports and depending on port operation (ie. ports operating as open valves or timed valves). The fluid is then discharged through the outlet port.

Figure 6:
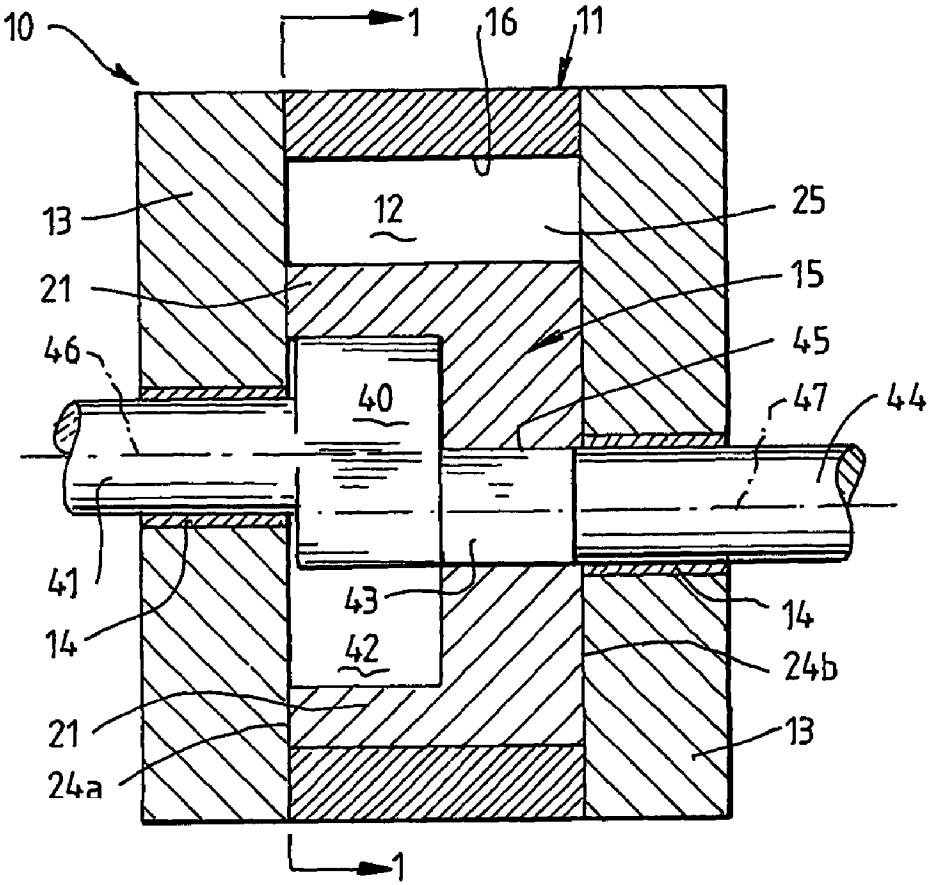
FIG. 6 is a schematic cross-section of the first embodiment of the rotary mechanism taken along line 6-6 of FIG. 1 and illustrates along line 1-1 the corresponding cross section which is FIG. 1.

Both embodiments illustrated in the drawings, show the rotary mechanism 10 including a housing 11 with a substantially annular chamber 12. The chamber 12 is defined by an inner chamber wall 16 and housing end covers 13, the end covers 13 differing in structure between embodiments (see FIGS. 6 and 12). Each end cover 13 supports a shaft journalled in a bearing 14 in the covers. Whilst the embodiments disclosed herein illustrate a single block shaft or a split shaft extending from each cover, it is understood that the nature of the rotor, in particular with reference to the second embodiment, may be such that the mechanism can adequately operate with a single block shaft, extending through only one end cover 13.

Located within chamber 12 is a two-lobe lenticular rotor. The rotor is symmetrical in shape about a major longitudinal axis 20 and a perpendicular minor axis 23. The intersection of the major and minor axis defines the central axis 30 of the rotor. The major longitudinal axis 20 of the rotor intersects the junction of the two lobes 21, namely the rotor apices 22. The two symmetrical lobes 21 taper inwardly along the major axis 20 to the apices. Spring loaded tip seals (not shown) extend outwardly from the apices and are adapted to continuously abut the inner wall 16 of the chamber. The spring loaded nature of the tip seals bridge small gaps between the chamber wall 16 and apices 22 that may be brought about by imperfections or by design in the chamber wall.

End surfaces 24*a* and 24*b* on the rotor are parallel to each other and move at close clearances against the stationary end covers 13 of housing 11. The clearance between each end surface and adjacent end cover 13 should allow for uninhibited rotor movement but prevent leakage of fluid between the rotor and end covers. Introducing seals on the sides of the rotor and a lubricant between end covers 13 and end surfaces 24*a* and 24*b* assists rotor movement and seals clearances against leakage.

The rotor is adapted to eccentrically rotate within the chamber 12 sliding in a circular-conchoidal fashion such that the apices continuously sweep along the inner chamber wall 16 and are in sealing contact with the inner wall to create enclosed cavities 25 adjacent each lobe 21 which successively increase and decrease in volume with each revolution of the rotor 15. The tip seals at the apices prevent leakage of fluid between cavities 25. The varying volume of the enclosed cavities 25 are attributed to the circular-conchoidal path the rotor 15 follows as it rotates within the chamber. That is to say, the central axis 30 of the rotor is not a fixed point in relation to the chamber 12, but rather follows a circular orbit referred to as a centrode 33 orbiting an origin 31 located off-centre to a central axis 32 of the chamber.

In the first, split shaft embodiment illustrated in FIGS. 1 to 6 the origin 31 is located midway between the axial centres 46 and 47 of the first split shaft 41 and second split shaft 44 respectively. In the second, straight shaft embodiment illustrated in FIGS. 7 to 12 the origin 31 is located midway between the central axis 32 of chamber 12 and the axial contra 57 of the single shaft 50.

With the rotor centrode origin 31 being offset from the chamber's central axis 32 the rotor slides and rotates eccentrically relative to the chamber and thereby creates two opposing cavities with continuously varying volumes. Sectional FIGS. 2-5 and 8-11 illustrate the geometric interrelationship of the components of the first and second embodiments of the mechanism respectively. In particular, the centrode 33 of the rotor and its origin 31 is clearly identified.

The chamber has been described as being substantially annular. Whilst an annular chamber can be quite satisfactory, it may, at some points on its rotating path, impart an undesirable load on the apices and specifically the tip seals. In order to obtain a reduction of this load, the internal shape of the chamber can be made non-circular and, rather, shaped according to the exact path circumscribed by the actual apices of the rotor, namely, a circular-conchoidal shape. In this case, this shape will not differ substantially from circular but, nevertheless, by so forming the chamber the loads on the tip seals and problems which can occur when there are varied loadings on tip seals can be, if not overcome, at least substantially minimised.

Figure 7:
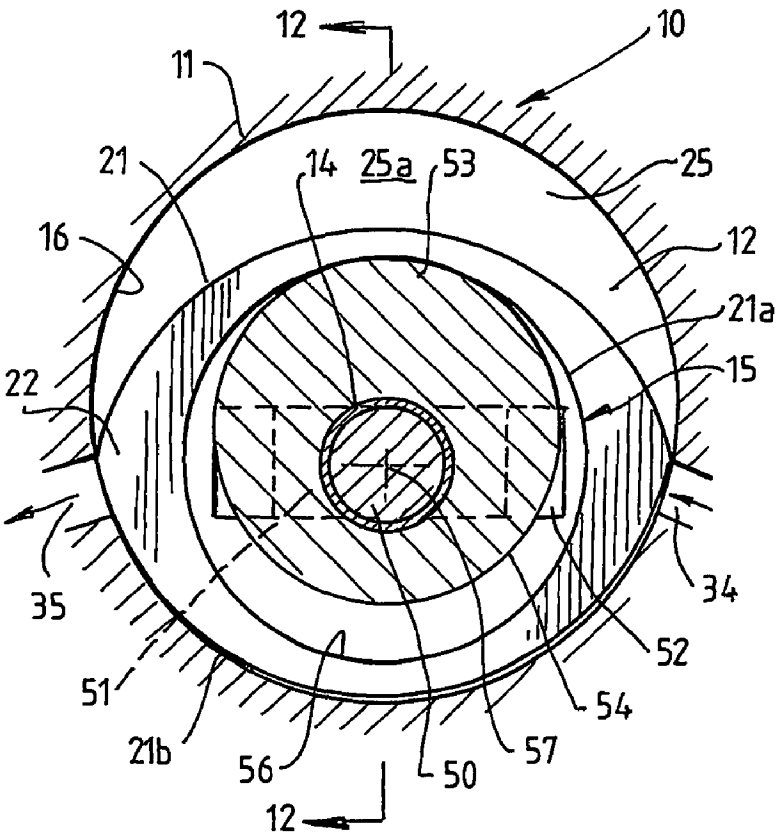
FIG. 7 is a schematic plan view of a second embodiment of the rotary mechanism in accordance with the present invention, with the rotor at top dead centre of the chamber.
Figure 8:
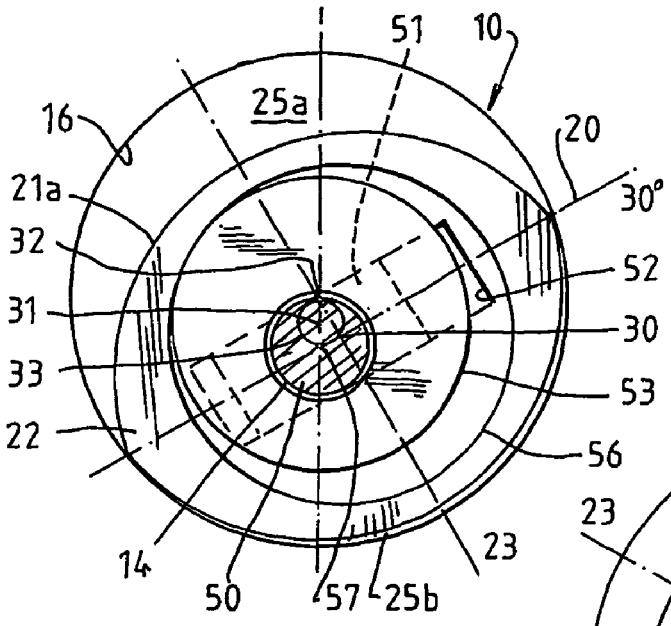
FIG. 8 illustrates the rotary mechanism of FIG. 7 with the rotor displaced by 30° counter-clockwise.
Figure 9:
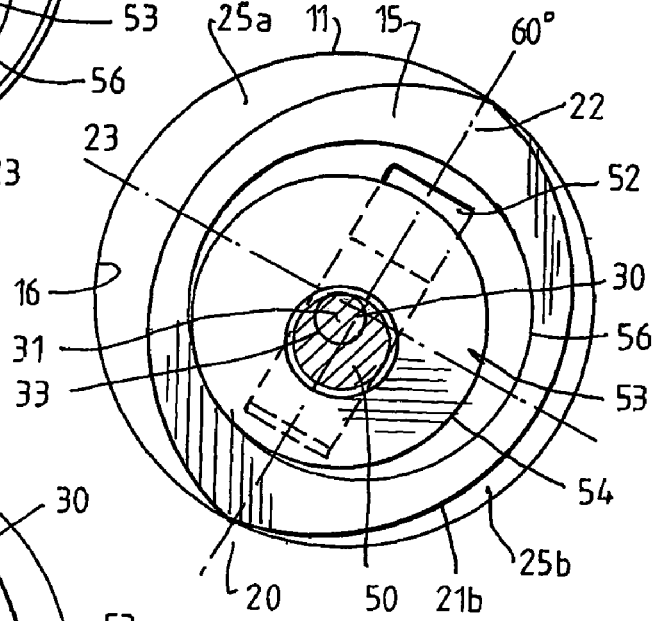
FIG. 9 illustrates the rotary mechanism of FIG. 7 with the rotor displaced by 60° counter-clockwise.
Figure 10:
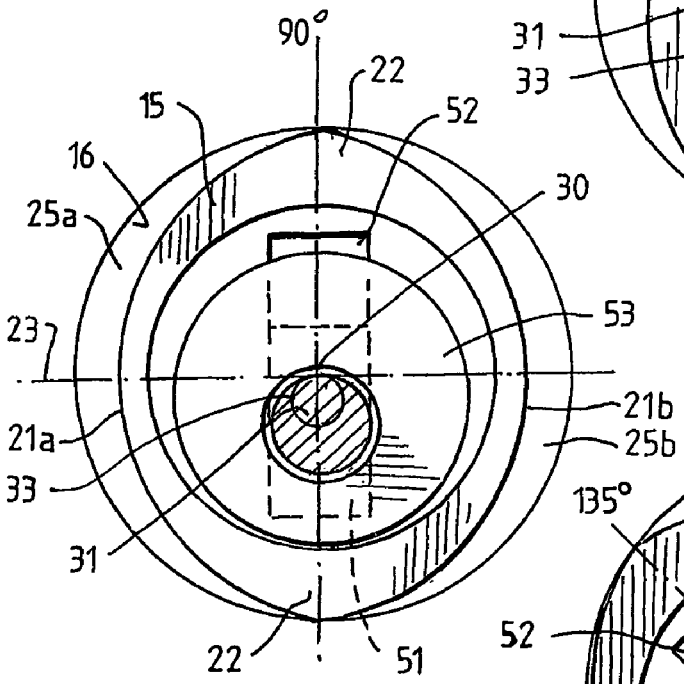
FIG. 10 illustrates the rotary mechanism of FIG. 7 with the rotor displaced by 90° counter-clockwise.
Figure 11:
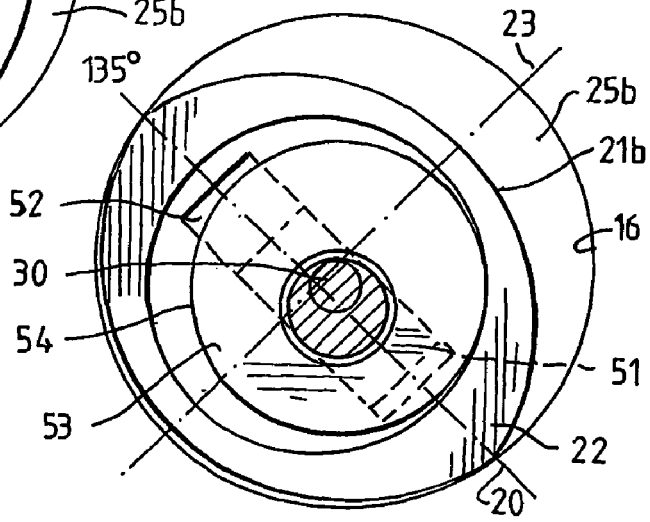
FIG. 11 illustrates the rotary mechanism of FIG. 7 with the rotor displaced by 135° counter-clockwise.

FIGS. 1 and 7 illustrate an inlet port 34 spaced from an exhaust port 35 on the inner chamber wall 16. Small variations of the spacing between the ports changes the fluid pressures in the chamber and timing of the mechanism thereby making it suitable for use in different applications. Any such modification would be determined according to the mechanism's desired application as an engine, pump, compressor, expander etc. Whilst some overlap between the ports is acceptable, generally, a cavity is only open to one port at any instant.

In use, unless the fluid is pre-compressed, fluid enters a cavity under a vacuum effect owing to the cavity increasing in size and hence creation of a negative pressure gradient. Once the cavity begins decreasing in size the inlet is closed and the exhaust port opened to discharge the fluid under compression. The process occurs in half a rotor revolution and the discharge can be described as a pulse. There are therefore two pulses per rotor revolution. Generally, there is no necessity for an inlet valve as the vacuum created by the enlarging cavity adequately draws in fluid. A one way valve may be used at the exhaust port to prevent back flow of fluid into the chamber.

Alternatively, an amount of pre-compressed fluid enters an expanding chamber followed by closure of the inlet. The pressure exerted by the fluid causes the chamber to expand in size thus providing torque to drive one or more shafts. Once the cavity starts decreasing in size, a port opens allowing discharge of the expanded fluid.

Precise eccentric rotor rotation within the chamber is important to ensure that the sweeping apices sealingly contact the inner chamber wall and prevent fluid leakage from the cavities 25. Whilst the spring loaded tip seals allow for some tolerance, care must be taken in designing the apices to positively sweep against the inner wall, that is to just touch or be spaced from the inner wall, but to not be forced against the inner wall, which would cause the apices to wear. Design features of the first and second embodiments of the rotary mechanism described herein inherently produce a precise eccentric rotation path along which the apices sweep positively.

Furthermore, despite the eccentric rotation, the interengaging components of the split shaft embodiments of the mechanism allow it to evenly and smoothly bear the rotational loads of the rotor. In the straight shaft embodiment virtually all the load is borne by the single block shaft making complex bearing arrangements for the interengaging components unnecessary.

Both first and second embodiments of the mechanism has a driving means, or in the case of the mechanism's application as an engine or gas expander, a driven means. Both embodiments also have a guiding means. In the first embodiment the split shafts act both as a driving means and guiding means. In the straight shaft embodiment there is a dedicated guiding means. In both embodiments the driving/driven means and/or guiding means contribute to causing the centre of the rotor to follow a circular orbit (that is, the centrode) in the chamber.

In the first embodiment illustrated in FIGS. 1 to 6 (split shaft embodiment) the driving means comprises first and second block and shaft arrangements. A first rectangular block 40 is fixed on the end of a first split shaft 41 of the mechanism 10 and mounted for reciprocal movement in a first elongated slot 42 in one of the end surfaces 24*a* of the rotor. First slot 42 is parallel to and lies along the rotor's minor axis 23. Axial centre 46 (FIG. 2) defines the central axis of first split shaft 41. A second rectangular block 43 is mounted on the end of a second split shaft 44 and disposed in a second elongated slot 45 (FIG. 2) located on the opposite end surface 24*b* of the rotor. The second elongated slot is oriented at right angles to the first slot, that is, along the major axis 20. Axial centre 47 is the central axis of second split shaft 44. Both the first and second split shafts 41 and 44, which, as previously mentioned, are journalled in the end covers 13 of the chamber 12, are arranged with one shaft coaxial with the central axis 32 of the chamber, namely first shaft 41, and the other displaced therefrom, namely second shaft 44. The amount of displacement is dependent upon the size of the chamber, which is determined by the distance between the two shafts, and the profile of the rotor. The sectional view of the mechanism illustrated in FIG. 6 clearly shows the offset split shafts and perpendicular block and slot arrangements.

On rotation of either first or second shafts 41 or 44, or both, rotor 15 is driven round the chamber by virtue of the linear reciprocating motion of the slots over respective blocks. The rotation of the shaft(s) and simultaneous interaction of the split block shafts forces rotor 15 to move round chamber 12 in sliding and an eccentric, but controlled fashion such that the apices sweep the inner chamber wall 16 at close clearances.

As a result of the location of the two slots at right angles, the blocks 40 and 43 effectively locate the rotor within the chamber with accuracy so that the apices 22 are constrained to follow the inner wall 16 of the chamber. The lobes 21 themselves adopt positions throughout a revolution where they are successively closer to or further spaced from the adjacent part of the inner chamber wall.

Figure 4:
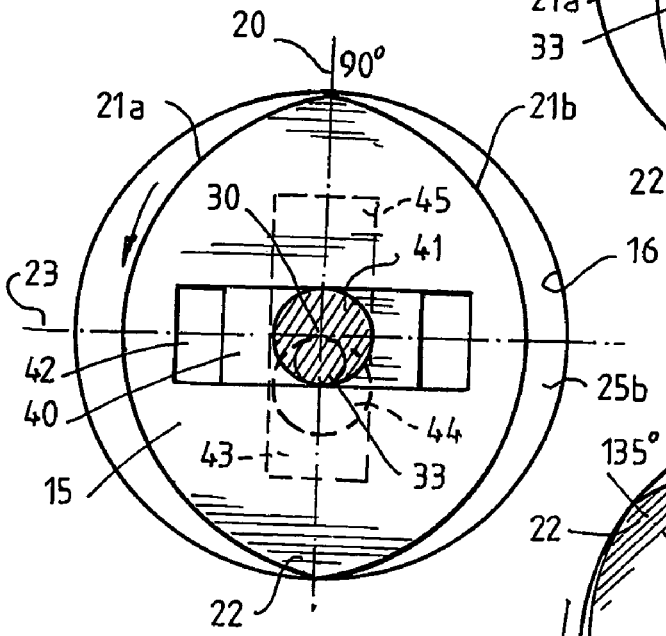
FIG. 4 illustrates the mechanism of FIG. 1 with the rotor displaced by 90° counter-clockwise.
Figure 5:
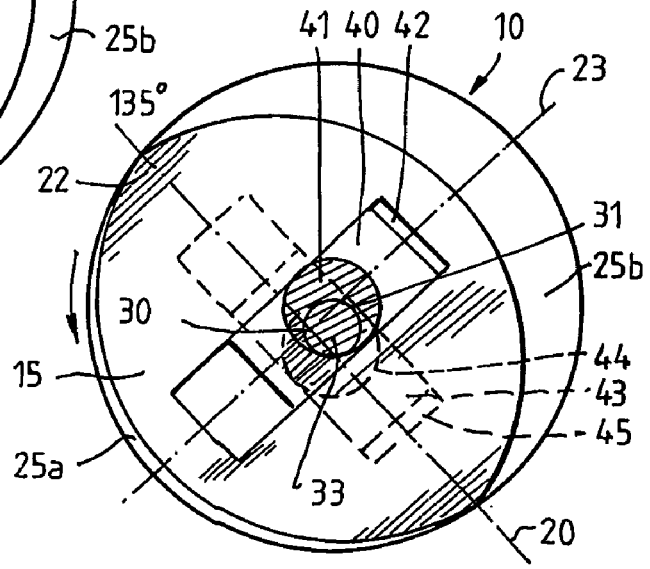
FIG. 5 illustrates the mechanism of FIG. 1 with the rotor displaced by 135° counter-clockwise.

FIGS. 1 to 5 illustrate a half revolution of the rotor at intervals of, firstly, 30° and then, between FIGS. 4, 5 and back to FIG. 1, at intervals of 45°.

FIG. 1 illustrates the start of the revolution where fluid has already been drawn into a first enclosed cavity 25*a* with the rotor closing the cavity 25*a* to both the inlet port 34 and exhaust port 35. The rotor at this position is at top dead centre. In particular, first rectangular block 40 is located at the top end of first slot 42, while second block 43 is located centrally of the second slot 45, spaced an equal distance from the ends of the second slot. Mutual rotation of one or both block shafts 41 and 44 forces the slots to slide over their respective blocks thereby eccentrically rotating rotor 15 in chamber 12.

FIGS. 2 to 5 show the revolution of rotor 15 and the reciprocal sliding movement of the first and second slots over their associated blocks. The inlet and exhaust ports have been omitted from FIGS. 2 to 5 for the purpose of clarity, but it can be imagined that with a second enclosed cavity 25 forming along the lower portion of the chamber in FIG. 2 adjacent second lobe 21*b*, fluid is drawn into the second cavity 25*b* through the inlet port under vacuum pressure in enlarging cavity 25*b*.

Simultaneously, adjacent the first rotor lobe 21*a* the fluid in the first enclosed cavity 25*a* is being forcefully discharged through the exhaust port 35. Hence with each revolution the mechanism draws in, compresses and expels fluid twice, that is, at two pulses per revolution. The operations occurring on one side of the rotor is therefore the same as the operations occurring on the opposite side of the rotor, but 180° out of phase.

The second embodiment of the invention (single shaft embodiment) is illustrated in FIGS. 7 to 12. All similar features to the first embodiment are given the same reference numerals. The second embodiment comprises a single block shaft 50 having a longitudinal axis 57 and extending right through the mechanism from one end cover 13 of the chamber to the other. The single block shaft 50 extends through the rotor and carries a driving block 51 inside the rotor 15.

The driving means in this embodiment comprises only the driving block 51 disposed within an elongated slot 52 for reciprocal sliding movement. Slot 52 is aligned along the rotor's major axis and extends right through the width of the rotor. As shaft 50 is rotated, the slot moves over driving block 51 to move the rotor eccentrically round the chamber. The shaft 50 itself is off-set from the central axis 32 of the chamber to provide a rotor displacement relative to the chamber thereby creating enclosed cavities of varying volumes.

Figure 12:
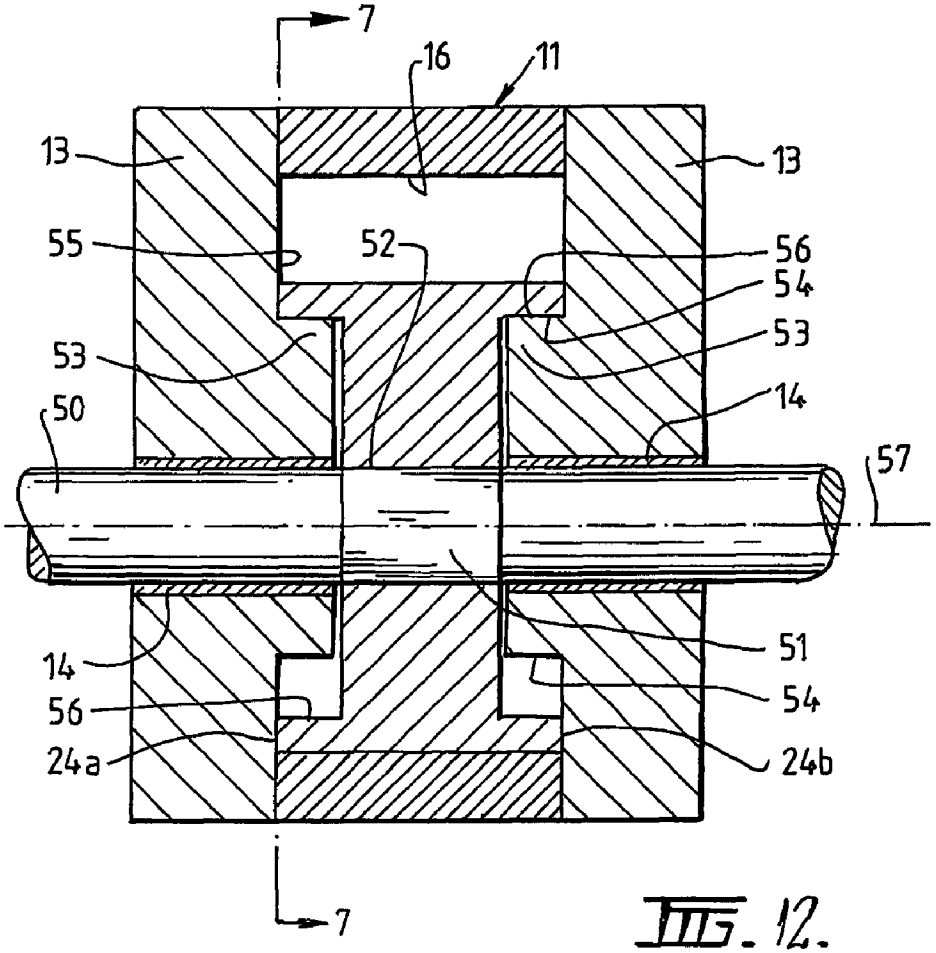
FIG. 12 is a schematic cross-section of the second embodiment of the rotary mechanism taken along line 12-12 of FIG. 7 and illustrates along line 7-7 the corresponding cross section which is FIG. 7.

This embodiment includes a guiding means to eccentrically guide the moving rotor round the chamber. The guiding means comprises two round guiding discs 53 projecting inwardly of the chamber 12 from the end covers 13 of the housing. FIG. 12 best illustrates the projecting guiding discs 53. The discs 53 can be either integrally formed with the end covers 13 or can be made separately and independently attached to the end covers. A step 54 separates the discs from a recessed annulus 55 around each disc.

Both end surfaces 24*a* and 24*b* of the rotor are provided with circular recesses 56 corresponding to, but larger than, the guiding discs 53. Circular recesses 56 on either end of the rotor are adapted to receive the respective guiding disc 53 on the adjacent end cover 13. Since the circular recesses 56 are larger in diameter than the discs 53, rotor 15 is capable of moving about the discs but with limited displacement owing to the constraint from the difference in diameter between the discs and circular recesses. The difference in diameters is determined by the difference in offset between the axial centre 57 of shaft 50 and the central axis 32 of the chamber. This distance in turn is determined by the varying capacity of the cavities for a particular application. As a combined result of the offset shaft and rotor displacement required to ensure the apices continuously sweep the inner wall of the chamber, the circular discs 53 are located with their centre at a midpoint between the central axis of the chamber and axial centre of shaft 50. Hence, the guiding discs 53 also have a centre that is offset from the central axis 32 of the chamber and that is also the same point as the origin 31 of orbit of the centre of the rotor. Specifically, guiding discs 53, and the combined guiding effect of the discs interengaging with the recess, are centred on the orbital origin 31 such that the rotor is allowed to rotate without applying any significant load on the guiding components.

The constraint in movement dictated by the guiding means combined with the block and slot arrangement produces a precise conchoidal path of the rotor apices where the apices continuously circumspect, in sealing contact, the inner chamber wall 16. In actual fact the path scribed from the rotor's natural movement around the chamber with the apices constantly sweeping the inner wall is dictated by the configuration of the combined guiding means. It is of course understood that the guiding means may function with only one guiding disc, but the provision of a disc on each end cover is preferred because it provides balanced and symmetrical rotor movement.

FIG. 12 illustrates discs 53 received in the rotor's circular recesses 56. Movement of the rotor is limited by disc steps 54 abutting the walls of the circular recesses.

FIGS. 7 to 11 illustrate a half rotor revolution at the same intervals as those illustrated in the first embodiment. Namely, FIGS. 8, 9, 10 and 11 respectfully illustrate the rotor displaced 30°, 60°, 90° and 135° from the top dead centre position illustrated in FIG. 7. It can be seen that the block shaft 50 is itself mounted off-centre to the centre of the guiding discs 53 and the central axis 32 of the chamber 12 in order to attain the desired path of rotor revolution.

FIGS. 8 to 11 schematically illustrate rotor 15 rotating within chamber 12 which movement is driven by elongate slot 52 sliding reciprocally over rotating driving block 51. Further movement constraints are introduced by the rotor's circular recess 56 being limited by guiding disc 53. As discussed with the first embodiment, the rotor centre (at its central axis 30) follows a centrode 33 about an origin 31. The intersection of major and minor axes in FIGS. 8 to 11 (also applies to FIGS. 2 to 5) represents the rotor centre 30. The rotor centre 30 is illustrated in FIGS. 8 to 11 orbiting along path 33 as the rotor eccentrically revolves in the chamber. It can also be seen that centrode 33 of the rotor is concentrically aligned with guiding disc 53.

The benefit derived from the guiding discs is that they allow for a straight block shaft to extend through the entire chamber from one end cover 13 to the other and allow the shaft to bear all the rotational load with the discs only acting as a guiding means. This eliminates all rotor tilt and reduces vibrations in the mechanism. As a result the mechanism's design is simpler than known designs as there is no requirement for heavy duty roller bearings to rectify shaft misalignment and play resulting from tilting rotors. Fewer parts and a simpler design reduce the overall manufacturing costs of the mechanism.

Additionally, the circular discs guided by the circular recesses provide an arrangement where the wear factor between the rotor and chamber is drastically minimized because the contact loads between the interengaging disc and recess are equally distributed along the disc and recess. That is, all points on the circumference of the guiding disc 53 wear evenly and all points on the inner periphery of circular recess 56 also wear evenly. The reason for this is that both components have contacting surfaces that match or are compatible, namely a circle rotating within a larger circle. In other words all points on the guiding disc remain in contact with the circular recess for an equal amount of time thereby reducing wear to a negligible amount, what wear occurring being evenly distributed around the components. This is not true of other incompatible arrangements such as a circular member in a parallel walled slot where some points on the member or slot are in contact with the slot walls or member respectively for different lengths of time, which will eventually lead to failure during operation.

The block and elongated slot arrangements illustrated in both the embodiments of FIGS. 1 to 12 illustrate the shafts connected to a block that is rectangular in profile and that slides within a correspondingly rectangular slot. The surface of the block and the internal surface of the slot are machining surfaces having a close tolerance to ensure maximum and smooth transfer of drive energy from the rotating shaft. The internal surface of the slot may be lined with a bearing surface for reducing friction.

Figure 13A:
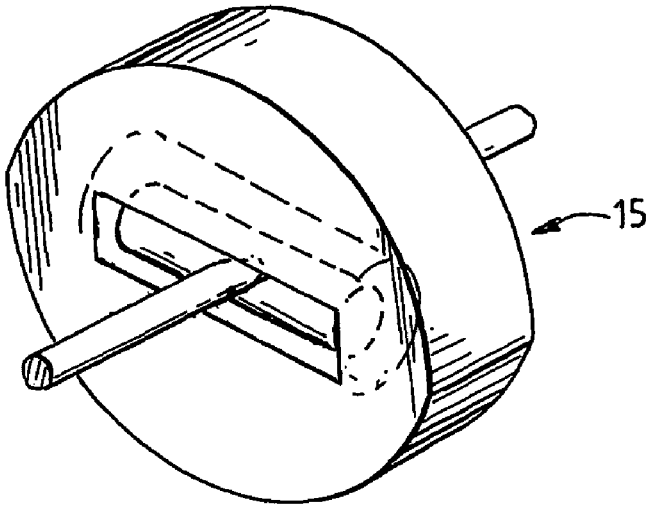
FIG. 13*a* is a perspective view of an embodiment of the rotor of the rotary mechanism showing the block and slot profile.
Figure 13B:
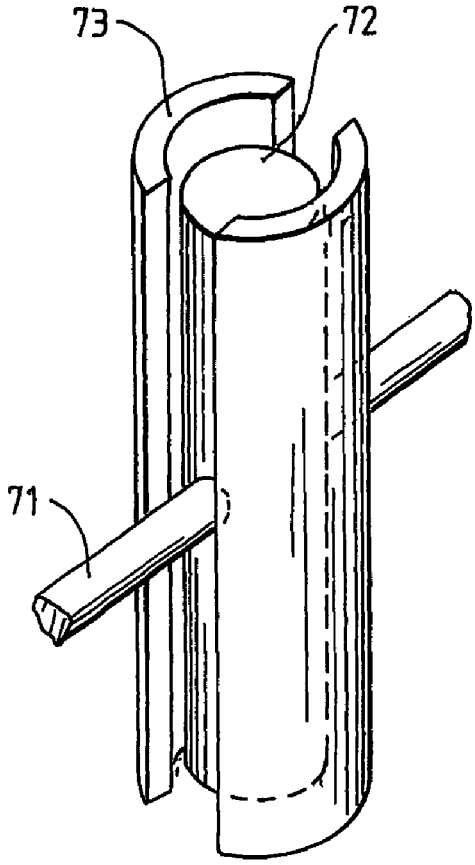
FIG. 13*b* is a perspective view of one block and slot geometric profile of an embodiment of the rotary mechanism.
Figure 13C:
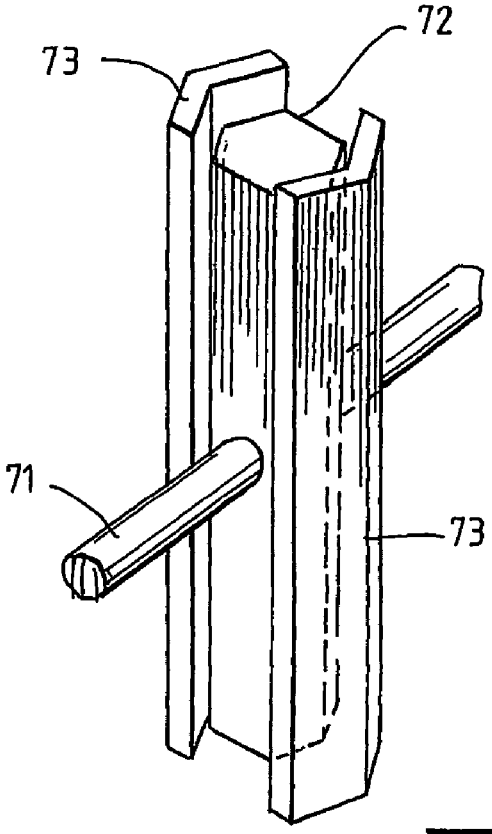
FIG. 13*c* is a perspective view of another block and slot geometric profile of an embodiment of the rotary mechanism.

The shaft block and corresponding bearing profile of the slot is illustrated in situ in the rotor in FIG. 13*a*. However, the block and bearing profile need not be rectangular in profile but can comprise other matching geometries. For example, FIGS. 13*b* and 13*c* illustrate respectively a cylindrical piston shaft/bearing surface profile and a cylindrical hexagonal profile. In these embodiments the shaft 71 extends through block 72 which slides in the correspondingly profiled bearing surface 73 inside the rotor's slot. Any variety of geometric shapes may be adopted for the block/slot profile provided the bearing surfaces are matching machining surfaces that at all times maintain constant and even sliding contact. The shape of the rotor/slot profile may be chosen to better suit manufacturing limitations and/or space constrictions of the rotary mechanism in different applications.

Additionally the near circular configuration of the mechanism is the optimal design for a number of machines. However, the shape of the mechanism can be modified if its modification is more suitable to a particular machine. The conchoidal path scribed by the rotor and the corresponding shape of the chamber are a result of the combined guiding influence of the offset shaft and block in the corresponding slot and, in the second embodiment, the circular discs at the end of the chamber covers that are received in corresponding recesses in the rotor sides. A change in shape of any of these parameters results in changes in the shape of motion and path. The shape of the rotor and housing profile may also be modified in order to better suit a particular function.

Figure 13D:
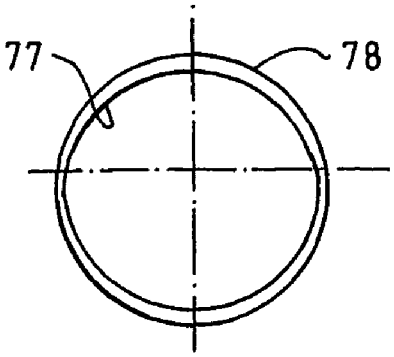
FIG. 13*d* illustrates two alternatives to the shape of the housing chamber in accordance with embodiments of the invention.

For example, the shape of the housing can be made to be annular or conchoidal. A conchoidal-shaped housing is shaped to closely follow the rotor apices as they sweep the inner wall of the chamber. This shape provides a minimal clearance between the rotor apices and chamber wall at any point. FIG. 13*d* illustrates a conchoidal chamber profile 77 overlapping an annular chamber profile 78. While the conchoidal profile is substantially annular, differences in the profiles are evident. Other modifications include altering the shape of the housing end covers and the shape of the rotor faces. Such modifications may better suit the function of the machine containing the rotary mechanism and may, for instance, improve bearing loads, increase clearances, change flow rates, optimize timing of ports, provide for recessed combustion chambers, and the like.

Unlike many known rotary mechanisms, both embodiments of the present mechanism easily endure loads and are well balanced because all rotational loads are evenly distributed across the driving means. To further reduce vibrations to a negligible extent rotating counterweights can be used to effectively balance the rotor. Rotor vibrations occur because the mass centre of the rotor revolves twice per each rotor revolution. To counteract this vibration a balancing mechanism is introduced to revolve at the same rotational speed and at the same revolutions as the mass centre of the rotor, namely twice per revolution of the rotor and shaft. This can be achieved by using a 1:2 gear ratio.

Figure 14:
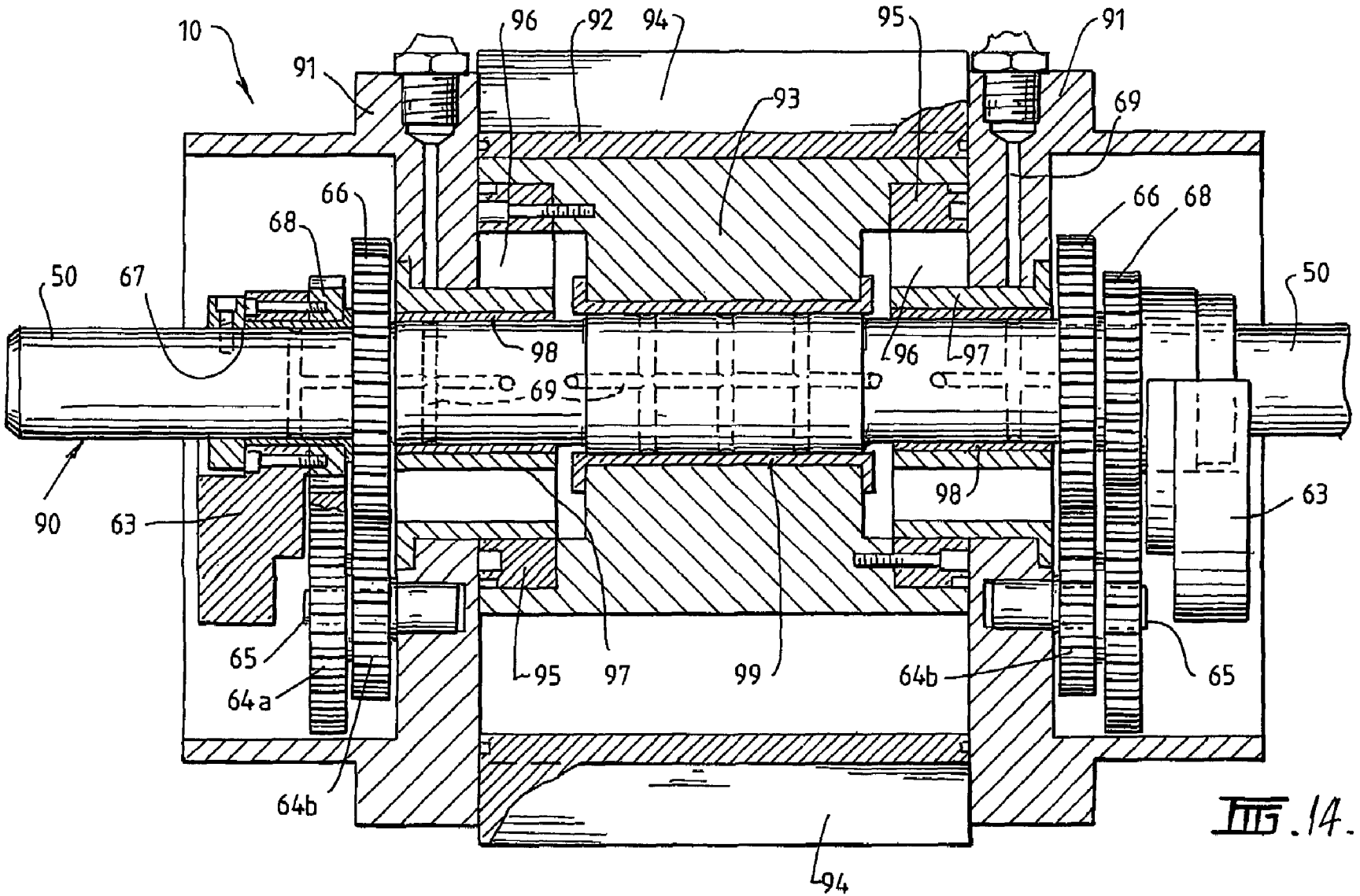
FIG. 14 is a cross-section view of the second embodiment operating as an air compressor.
Figure 15:
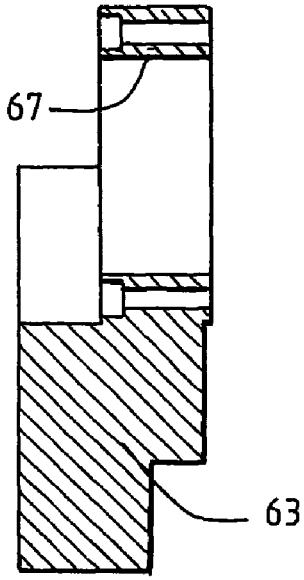
FIG. 15 is a sectional view of the balance weight appearing in FIG. 14.
Figure 16:
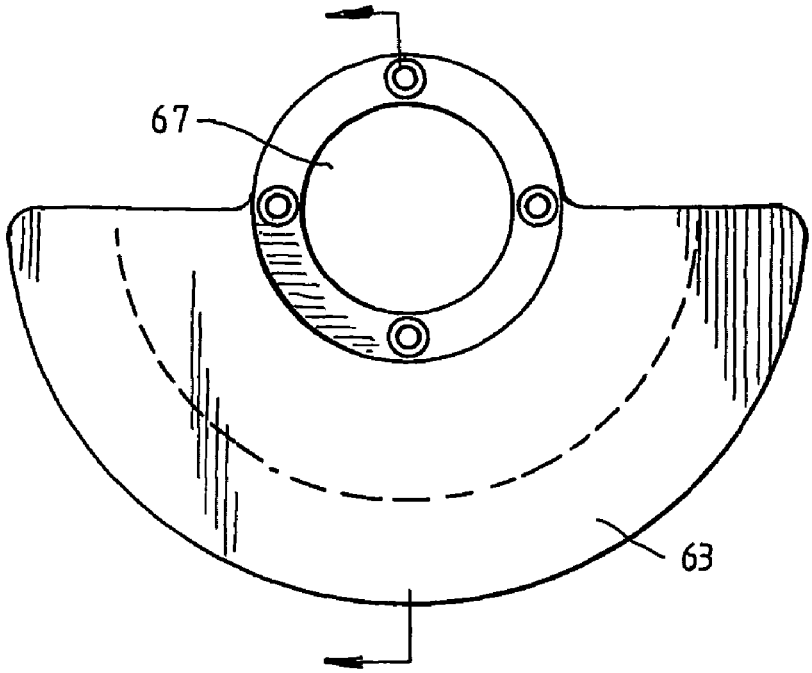
FIG. 16 is a front view of the balance weight.

The balancing mechanism is shown in FIGS. 14 to 16 which illustrates an embodiment of the straight shaft rotor mechanism 10 operating as an air compressor. In the air compressor illustrated in FIG. 14 the rotary mechanism 10 is driven by a drive shaft 90 and bound by side covers 91. Drive shaft 90 rotates on main bearing 98 and the rotor 93 slides with respect to drive shaft 90 on slide bearing 99. The housing 92 of the rotary mechanism houses the rotor 93 and supports cooling fins 94 extending radially from the housing 92. A ring holder 95 locates in the circular recesses 96 of the rotor 93 and provides for recessed bearings (ring) and oil scraper rings. Oil rings are used to control the cooling oil from within the rotor entering the compression chamber, serving the same function the oil rings do in piston or Wankel rotary engines. The ring holders revolve around the discs to create the path of movement of the rotor in conjunction with the shaft/block and rotor slot. The rotor recesses 96 of the ring holder rotates around the stationary guiding discs 97.

The balancing mechanism comprises a balancing weight 63 which has a bore 67 that is journal mounted on rotor shaft 50 to rotate about shaft 50 twice for each revolution of the shaft. FIG. 16 shows that balance weight 63 derives its mass from a semi-circular configuration below bore 67.

Balancing weight 63 is screwed into weight gear 68 which is also journalled to rotate about the shaft twice as fast as the shaft. Weight gear 68 is driven by large and small pinion gears 64*a* and 64*b* respectively. Large and small pinion gears are co-axially fixed to one another on pinion shaft 65. Large pinion gear 64*a* is twice the size of small pinion gear 64*b* and together provide the 1:2 ratio required to cause the balance weight to rotate at the same speed as the rotor's centre of mass. Small pinion gear 64*b* is driven through drive gear 66 that is mounted on and rotates with rotor shaft 50.

Driving balancing weight 63 in this manner allows the weight to rotate in unison and counteract the out of balance forces caused by the centre of mass of rotor 15.

In terms of the rotary mechanism's use as an air compressor a balancing mechanism is only really needed for large displacement air compressors where the vibrations are significant. Air compressors having small capacities, for example below 300 cc per cycle, do not usually vibrate to a significant extent.

The decision on whether or not to use balancing mechanisms further depends on the mass of the rotor and its materials. A lighter rotor is less likely to produce significant vibrations than a heavier rotor.

However, in general vibrations produced by the present rotary mechanism are low compared with other types of rotary mechanisms. Excellent balance can be easily achieved. This is because the eccentricity of movement of the centre of mass of the rotor is very low compared to, for instance that of a piston in a cylinder having similar capacity.

The rotary mechanisms geometry is such that it reduces mechanism vibrations, reduces wear, eliminates areas of high stress and, on the whole, generally extends the life of the mechanism. Furthermore, with the straight shaft embodiment, the mechanism has only two significant working components within the chamber, namely the slot sliding over the block and the recesses moving round the fixed discs, thereby reducing the complexity of the mechanism.

The profile geometries of the housing and rotor can be calculated for optimum effect depending on the application of the rotary mechanism from an analysis of the rotary mechanisms kinematics.

By an analysis of the kinematics of the rotary mechanism mathematical equations can be derived to describe, and therefore produce, rotor and housing geometries. Such mathematical equations may be embodied in a computer software program that produces the coordinates required to manufacture the rotor and the housing. The geometric profiles may be calculated using at least the desired values of the maximum chamber radius and the offset distance from the first shaft to the centre of the housing. The desired clearance between the rotor and the housing may also contribute to geometric calculations.

Figure 17:
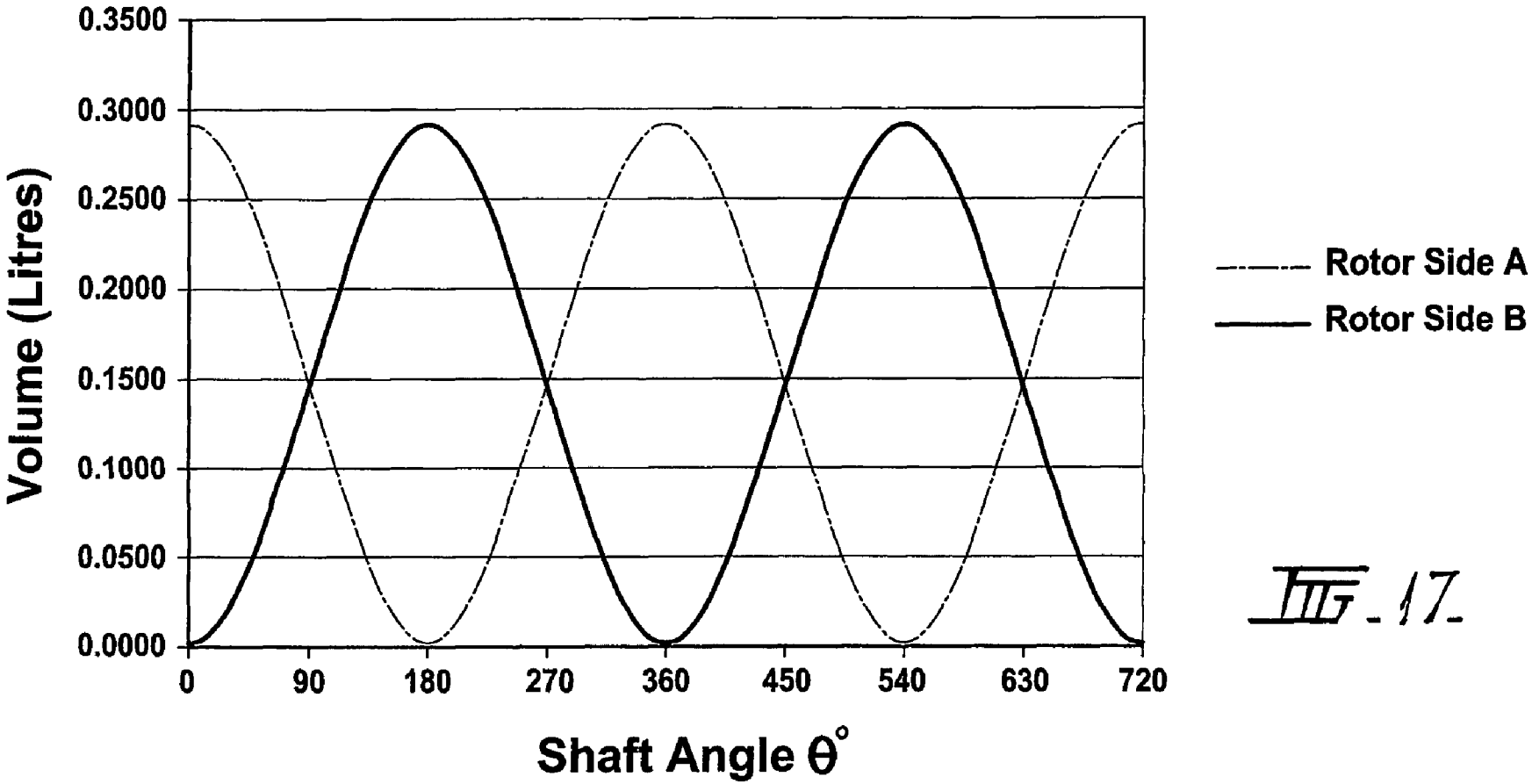
FIG. 17 is a graph illustrating an embodiment of the rotary mechanism's function of volume against shaft angle.

A feature of the rotary mechanism is that it produces a harmonic cycle whereby the volume of the processed charge is a simple sinusoidal function of the shaft angle, $\theta$. In mathematics, the graphical representation of a simple oscillating motion and similarly that of a point moving along a circle amounts to a sinusoidal curve. The simple sinusoidal nature of the expansion-compression cycle produced by the rotary mechanism simplifies the design and analysis of machines incorporating the present mechanism. Such performance characteristics as volume processed, delivery pressure and torque can be calculated as a function of the shaft angle FIG. 17 illustrates the rotary mechanism's sinusoidal function of volume as a function of shaft angle $\theta°$ in its application as an air compressor. The simple nature of the mechanism and its consequent simple harmonic nature can be expected to be favourably reflected in the performance and efficiency of machines based upon it.

In addition to the apex seals, adequate sealing technology is applied to the rest of the rotary mechanism. In the single shaft embodiment the circular recesses 56 are suitable for accommodating round oil seals which are more effective at sealing and easier to locate than non-circular seals. The small size of the discs and corresponding size of the rotor recesses provide for easier sealing and greater flexibility in the mechanism when designed for different applications. Gas sealing technology can also easily be applied to the present mechanism in its capacity as an engine. It will be appreciated that in this application of the mechanism, the sealing grid of the apex and side seals work in unison with the ports and valves to effectively seal the chamber for combustion.

In its embodiment as an air compressor, the rotary mechanism can be installed with simple and inexpensive air seals. Seals are used at the apex and also at the sides of the rotor to create an effective sealing grid in three dimensions for increasing the thermodynamic and operational efficiency of the compressor. In contrast this degree of sealing cannot be used on screw and vane type compressors which instead rely heavily on very close tolerances and oil flooding to seal the air charge.

The effective sealing used with the present rotor mechanism enables air to be compressed to very high pressures even at low to moderate motor speeds. In addition to effective sealing, the rotor coming very close to the housing at top dead centre assists in creating high pressures. This beneficially allows for a variable capacity at varying speeds and high pressures. Most conventional air compressors rely on high rotational speeds to compress air to high pressures.

The uni-directional movement of the rotor within the chamber, when used as an engine, effectively creates very high turbulence necessary for quick and homogeneous combustion of the fuel-air mixture. This effect results in low emissions of exhaust gases.

Furthermore, oil seals on the side of the rotor are used to avoid problems with oil flooding in the chamber and for effective cooling of the rotor. FIG. 14 illustrates oil passages 69 for the oil to flow to the slides and bearings on the shaft and block, which are used to cool the mechanism in an air compressor. The air compressor needs only standard oil and water filters to separate the oil from the water/oil condensate in the compressed air. Accordingly, components such as an oil pump, oil separator, filters and controls used in lubricating and cooling the rotor need not be sophisticated for the mechanism to operate successfully. In comparison the high costs of producing sophisticated controls and an oil-air treatment system for screw and vane type compressors results in high manufacturing and sale costs.

Figure 18:
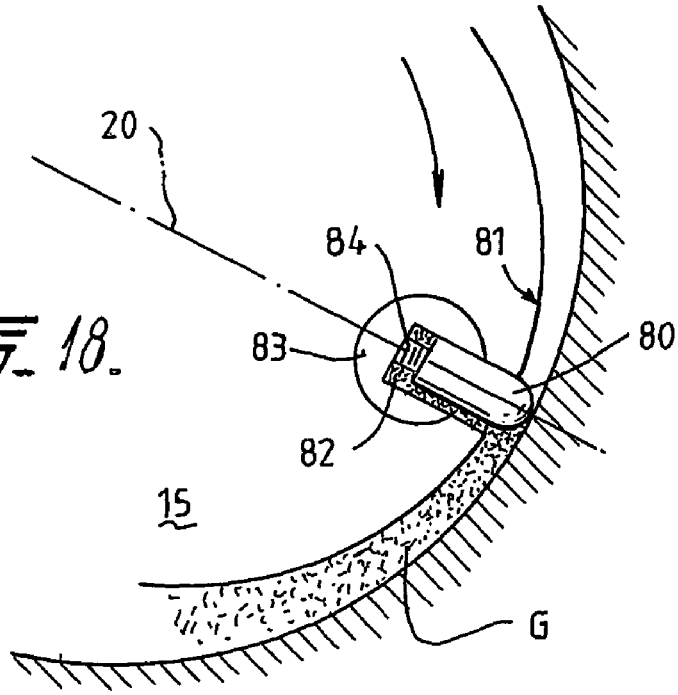
FIG. 18 is an enlarged view of a rotor apex against the housing of the rotary mechanism.

FIG. 18 is an enlarged view of a spring loaded seal 80 at the apex 81 of a rotor 15. Seals 80 are located against springs 84 inside longitudinal grooves 82 that are machined at the rotor apexes 81 and are held therein by button seals 83. In the embodiment illustrated in FIG. 18 the rotor is rotating in a clockwise direction and the seal 80 contacts the housing interior. This contact is always positive in that there is always contact with the housing, and during compression gas G enters the groove thereby forcing the apex seal from behind to bias outward of the groove and contact the housing. At the same time the apex seal 80 also contacts the side of the groove to prevent fluid from escaping around the seal and providing effective sealing. This continual contact of seal against housing not only provides for better sealing of the chamber but also results in minimum wear of the seal and housing. In this arrangement there are no abrupt changes in the magnitude of the forces acting on the seals.

The "close to annular" design of the rotor housing also contributes in effectively sealing the mechanism. The housing shape is sympathetic to the path followed by the rotor apex so that the seal at the apex slides effectively without producing any negative forces on the housing. The positive forces of the apex seal means that that mechanism experiences negligible losses of compressed air throughout its cycle across all motor speeds. In comparison, the housing of the Wankel rotary engine, which resembles in shape a figure "8", experiences negative forces near the waist, and hence loses compressed air at this point.

A benefit provided by the circular or conchoidal path of the housing is that it doesn't experience problems experienced in housings of other rotary mechanisms, such as "chatter marks". The loss of contact of the apex seals at the waist of the housing of a Wankel engine means that when contact is resumed the seals impact harshly against the housing producing the phenomenon known as "chatter marks". This does not occur with the present rotary mechanism because the seals never lose contact with the housing.

In air compressors the rotary mechanism has no use for suction valves, only suction ports. Suction ports are always located on the rotor housing. However, fitting discharge valves in the discharge ports can make the compressor operate more efficiently. The discharge ports can be provided on either the rotor housing or on each side cover. For best performance it is important to carefully select the positioning of the discharge ports, with or without valves, with respect to the rotating rotor.

Always exposing the suction ports to atmospheric pressure produces a high volumetric efficiency, which is further encouraged by the positive displacement of the rotor. One benefit of having valves at the discharge port is an increase in cooling by the fact that fluid continually flows in one direction and heat dissipates through the valve port system.

The symmetrical nature of both embodiments of the present mechanism allows the mechanism to operate with minimal vibration and the rotational forces resulting from the rotor's mass are evenly distributed and borne successively by all points on the rotor. In other words, there is no particular section of the rotor that bears more load than any other section that would otherwise create an area of concentrated structural stress. Counterweights, as described above, or other balancing technology may be used to balance the rotor and reduce vibrations to an absolute minimum.

The rotary mechanism finds use in many applications including hydraulic, vacuum and oil pumps, gas compressors and expanders and engines. The high compression achieved combined with a lightweight and compact structure provides significant advantages over known mechanisms.

Taking as an example the use of either embodiment of the rotary mechanism as an internal combustion engine, it can be visualised that at top dead centre where the rotor is substantially displaced towards the periphery of the chamber (as illustrated in FIGS. 1 and 7), there had been a previous induction so that there is a fuel/air mixture about to be compressed. The situation can be considered analogous to piston movement towards the top dead centre of the compression stroke in a piston engine.

A portion of the periphery of the rotor may be relieved to provide a chamber which may, at this position, be effectively located under a spark plug or other ignition device. Also, at this position, either the ports into the enclosed cavity of the chamber may be covered by the rotor itself or valves associated with the ports could be closed.

On ignition, the power and exhaust stroke commence and the rotor is caused to rotate. The lobe of the rotor adjacent the inner chamber wall tends to move away from the wall because of the movement of the rotor caused by the combustion in the cavity. At this time the exhaust port opens and the pressure of gas and unburned fuel in the cavity causes effective expulsion of the exhaust gases which are passed from the cavity through the exhaust port.

The use of the mechanism as a two-stroke engine is more effective if associated with a separate super charger, preferably a rotary super charger. In such an arrangement, the inlet is under pressure so that, provided appropriate porting and valve system, a charge can be fed to the chamber without an induction stroke, the introduction of which charger also assists in complete extraction of the exhaust. In such an arrangement there are two pulses of two-stroke power for each revolution of the rotor.

It can thus be seen that in the two stroke version, the engine is of high efficiency compared to a piston engine because of the frequency of power strokes.

It will also be appreciated that the slots and annular recesses make the rotor effectively hollow, and as access from the interior of the rotor to the end covers may be achieved through the slots, or through apertures, for example, apertures adjacent the slots, it is simple to lubricate and cool the engine of the invention simply by passing oil into the centre of the rotor. Alternatively one of the shafts may be made hollow, so that the rotor is partially or completely full of oil, and returning the oil through one or both slots or the apertures, and thus there is good heat transfer from the rotor to the oil. The guiding discs and chamber end covers themselves may also be provided with passageways, for example adjacent the bearings, for draining oil. The oil can then pass to a sump or the like. It may also be preferred to provide a radiator to cool this oil, either on the inlet to or the exit from the sump. From the sump, the oil can be pumped for recirculation. The oil, as it passes along the end surfaces of the rotor, also provides seal lubrication.

In order to achieve effective oiling of the seals, conventional methods may be used and these include the use of an oil/fuel mixture to introduce oil into the combustion chamber or a controlled loss oil injection method which directly introduces oil into the chamber.

The geometry of the mechanism is such that it possesses a large surface area which ensures effective heat dissipation and improved cooling performance. This is extremely beneficial when considering the overall efficiency of the mechanism, particularly when exposed to air such as when embodied as an air compressor having cooling fins.

Whilst the operative components of a rotary engine have been discussed, without going into specific mechanical construction and operation, it will be appreciated that the same arrangement can equally well be used as a positive displacement pump. As the apice of the rotor passes the inlet port at a position where the volume between the rotor and chamber increases, fluid at the port will be drawn into the chamber. On further rotation, as the lobe of the rotor moves closer to the inner wall of the chamber, the fluid is placed under pressure and can be delivered under pressure from an outlet port correctly located. Again, when operating as a pump, there are two pulses of fluid for each revolution of the rotor, thus giving a high order of efficiency as a pump.

It will be appreciated, and as briefly mentioned earlier, the particular location of the ports and the valves, if any, and, indeed, the valve types, can vary greatly depending upon whether the mechanism is being used as a rotary engine or as a pump, and the particular conditions and fluid with which it is to operate.

Also, if the mechanism is being used as a rotary engine, depending upon the designed speed of rotation of the engine, the location of the ports will be designed to provide the most effective induction and exhaust at the required speed of operation.

The rotary mechanism successfully operates with almost any kind of appropriate material. It does not require a sophisticated process for manufacturing the housing or any finishings. The mechanism can simply be made from materials such as cast iron. Where weight is a consideration lighter materials and composites may be more desirable.

Sophisticated electronic controls are not required to control and maintain this mechanism. In terms of compressors, many known machines use monitoring and operating controls to control heat, moisture, air/oil contamination, motor and "air" speed, vibrations, oil supply, humidity, and the like. In its simplest form the present mechanism embodied as an air compressor requires virtually none of these controls, save from a standard air/pressure switch to cut power under certain load conditions. Auxiliary controls may be considered in larger compressors having higher capacity but any such controls would be standard and easily obtained.

Whilst in this specification the rotary mechanism and its operation has been described in its simplest concept, it will be appreciated that, in a practical mechanism, there can be variations, which would be clear to one skilled in the art.

Also, the forms of fuel systems to be used if the mechanism is used as a rotary engine have not been described but are apparent to those skilled in the art. For example, the fuel source may be either a carburetor or a fuel injection system as required.

Some applications for the rotary mechanism have been described above. Further detail of these examples and further examples are now described.

The rotary mechanism finds use as an air motor in that compressed air can be used to run the mechanism as a motor. In fact all types of fluid expanders can find use with the rotary mechanism. These include steam or organic fluid Rankine cycle engines, Stirling engines, liquid refrigerant expansion valves, air cycle coolers, pneumatic starters, natural gas expanders, heavy metal pollution cleaning systems, and the like.

The concept of the rotary mechanism is useful from a micro level to a macro level. On a micro scale the present rotary mechanism exhibits excellent characteristics for micro machinery. For example, the same rotary mechanism concept can be used for a micro engine as well as a standard full size engine. Its simple, planar geometry and few parts (there are no gear mechanisms) means that on a micro scale the rotary mechanism is relatively simple to manufacture and operates with minimal maintenance. Rotor sealing even on a micro scale is effective because the sealing of the rotor tips is always positive against the housing. Effective sealing is critical to high performance. High compression ratios, even on a micro scale, are easily obtained producing effective compression ignition combustion when used as a micro engine.

The rotary mechanism lends itself to operate with many forms of fuel including hydrogen and ethanol. As an engine the mechanism can be made to operate at very low speeds and very high speeds.

On a macro scale the rotary mechanism can be designed as an internal combustion engine or other fluid expansion motor that is simultaneously capable of operating as an electrical generator. By placing suitable magnets in the rotor and coils in the housing an electrical generator may be incorporated into the engine.

The rotary mechanism with its potential for high compression opens up possibilities of being fueled by natural gas and hydrogen. The rotary mechanism has great potential as a hydrogen engine because it lacks hot spots and exhibits excellent cooling.

The mechanism's cooling characteristics can be attributed to: its large surface to volume ratio; the fact that each charge of air is positively displaced around the full circumference of the housing chamber; the air intake is remote from the discharge valves and is continuously open to thereby remain cool; with the valve on the discharge port the compressed air is quickly discharged to the tank to prevent leakages or back flow of hot compressed air back into the compressor; oil paths are provided inside the shaft for additional cooling; and unlike turbines and screw compressors, the mechanism does not churn or shear the air which would otherwise cause kinetic energy and heat the air.

The rotary mechanism finds great benefit as an automotive super charger.

It will be understood to persons skilled in the art of the invention that many modifications may be made without departing from the spirit and scope of the invention.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The claims defining the invention are as follows:

1. A rotary mechanism comprising:

a housing defining a substantially annular enclosed chamber with an inner wall;

a two-lobe symmetrical rotor having a central longitudinal axis between apices of the rotor, the rotor being disposed within the chamber so as to eccentrically rotate within the chamber in such a manner that the apices continuously sweep the inner wall thereby creating cavities between each lobe and the inner wall of successively increasing and decreasing volumes, wherein the rotor is mounted on a single shaft extending through opposite ends of the chamber, the shaft is centred offset to a central axis of the chamber and is carrying a first guiding means defined by a block mounted for reciprocal movement relative to an elongated slot located on the rotor, whereby the block and shaft allow for eccentric rotation of the rotor;

spaced inlet and exhaust ports for the supply and discharge of fluid into the cavities; and a second guiding means that interacts with the first guiding means to guide the rotor and ensure the apices, during operation, are in continuous sealing contact with the inner wall to cause a centre of the rotor to follow a circular orbit in the chamber, wherein the second guiding means is centred offset to a central axis of the chamber and comprises:

a circular guide disc mounted at, at least one end of the annular chamber; and a corresponding circle-shaped recess on one side of the rotor to receive the guide disc, wherein the recess has its origin at the centre of the rotor and is larger than the guide disk to allow the circle-shaped recess to revolve around the guide disk.

2. The rotary mechanism claimed in claim 1 wherein the second guiding means are components structured to have matching contact surfaces such that contact loads are equally distributed along inter-engaging guiding components.

3. The rotary mechanism claimed in claim 1 wherein the centre of the guide disc is off-centre to the central axis of the chamber.

4. The rotary mechanism claimed in claim 3 wherein the centre of the guide disc is located midway between the central axis of the chamber and an axial centre of the shaft.

5. The rotary mechanism claimed in claim 1 wherein two guide discs are provided, one at each chamber end, and wherein the discs are receivable in corresponding circle-shaped recesses located in each side face of the rotor.

6. The rotary mechanism claimed in claim 1 wherein the elongate slot is oriented along the longitudinal axis of the rotor.

7. The rotary mechanism claimed in claim 1 wherein the housing and rotor geometric profiles can be calculated from the diameter of the chamber and the shaft offset distance from the centre of the chamber.

8. The rotary mechanism claimed in claim 1 wherein the centre of the rotor moves in a circular orbit whereby the centre of the orbit is offset midway between a central through-axis of the chamber and the axial centre of the shaft.

9. A rotary mechanism comprising:

a housing defining a substantially annular enclosed chamber with an inner wall;

a two-lobe symmetrical rotor having a central longitudinal axis between apices of the rotor, the rotor being disposed within the chamber so as to eccentrically rotate within the chamber in such a manner that the apices continuously sweep the inner wall thereby creating cavities between each lobe and the inner wall of successively increasing and decreasing volumes, wherein the rotor is mounted on a single shaft extending through opposite ends of the chamber, the shaft carrying a first guiding means defined by a block mounted for reciprocal movement relative to an elongated slot located on the rotor, whereby the block and shaft allow for eccentric rotation of the rotor;

spaced inlet and exhaust ports for the supply and discharge of fluid into the cavities; and a second guiding means that interacts with the first guiding means to guide the rotor and ensure the apices, during operation, are in continuous sealing contact with the inner wall to cause a centre of the rotor to follow a circular orbit in the chamber, wherein the second guiding means comprises:

a circular guide disc mounted at, at least, one end of the annular chamber; and a corresponding circle-shaped recess on one side of the rotor to receive the guide disc, wherein the recess has its origin at the centre of the rotor and is larger than the guide disc to allow the circle-shaped recess to revolve around the guide disc.

10. A rotary mechanism comprising:

a housing defining a substantially annular enclosed chamber with an inner wall;

a two-lobe symmetrical rotor having a central longitudinal axis between apices of the rotor, the rotor being disposed within the chamber so as to eccentrically rotate within the chamber in such a manner that the apices continuously sweep the inner wall thereby creating cavities between each lobe and the inner wall of successively increasing and decreasing volumes, wherein the rotor is mounted on a single shaft extending through opposite ends of the chamber, the shaft carrying a first guiding means defined by a block mounted for reciprocal movement relative to an elongated slot located on the rotor, whereby the block and shaft allow for eccentric rotation of the rotor;

spaced inlet and exhaust ports for the supply and discharge of fluid into the cavities; and a second guiding means that interacts with the first guiding means to guide the rotor and ensure the apices, during operation, are in continuous sealing contact with the inner wall to cause a centre of the rotor to follow a circular orbit in the chamber, wherein the second guiding means comprises:

a circular guide disc mounted at, at least, one end of the annular chamber and off-centre to a central axis of the chamber; and a corresponding circle-shaped recess on one side of the rotor to receive the guide disc, wherein the recess has its origin at the centre of the rotor and is larger than the guide disc to allow limited movement of the rotor on the disc.

11. The rotary mechanism claimed in claim 1 wherein the rotor apices are provided with positive displacement seals located in grooves at the rotor apices that continuously contact the inner wall.

12. The rotary mechanism claimed in claim 11 wherein the seals are spring biased seals.

13. The rotary mechanism claimed in claim 11 wherein fluid in the cavities is permitted to enter the grooves and force the seals against the inner wall.

14. A machine containing the rotary mechanism claimed in claim 1 wherein the machine transfers, expands, compresses, or internally combusts a fluid.

15. The rotary mechanism claimed in claim 1 wherein the rotor profile and/or the chamber profile is modified to suit specific mechanical parameters.

16. The rotary mechanism as claimed in claim 1 wherein the shape of the guide disc and/or circle-shaped recess is modified to suit specific mechanical parameters.

17. The rotary mechanism claimed in claim 16 wherein the parameters are an increase in clearances, change in flow rates or a recessed combustion chamber.

18. The rotary mechanism claimed in claim 1 wherein the chamber profile is circular or conchoidal.

19. A machine comprising the rotary mechanism claimed in claim 1 and a balancing mechanism to balance the movement of the rotor in the rotary mechanism.

20. The machine claimed in claim 19 wherein the balancing mechanism rotates at two cycles per revolution of the rotor.

21. The rotary mechanism claimed in claim 15 wherein the parameters are an increase in clearances, change in flow rates or a recessed combustion chamber.

* * * * *